United States Patent [19]

Arnosky

[11] Patent Number: 4,468,549

[45] Date of Patent: Aug. 28, 1984

[54] INDUCTION HEATER ARRANGEMENT FOR FORGING BAR STOCK

[75] Inventor: Joseph E. Arnosky, Boaz, Ala.

[73] Assignee: Park-Ohio Industries, Inc., Cleveland, Ohio

[21] Appl. No.: 382,372

[22] Filed: May 27, 1982

[51] Int. Cl.[3] ..... H05B 6/40

[52] U.S. Cl. ..... 219/10.77; 219/10.43; 219/10.71; 219/10.49 R; 219/10.57; 219/8.5

[58] Field of Search ..... 219/10.43, 10.57, 10.69, 219/10.41, 10.71, 10.79, 10.49 R, 10.67, 10.75, 8.5

[56] References Cited

U.S. PATENT DOCUMENTS

| | | | |
|---|---|---|---|
| 1,981,631 | 11/1934 | Northrup | 219/13 |
| 2,379,463 | 7/1945 | Strickland, Jr. | 263/6 |
| 2,448,690 | 9/1948 | Storm | 219/9.5 |
| 2,749,423 | 6/1956 | Bisterfeld | 219/10.43 |
| 2,905,798 | 9/1959 | Freutel | 219/10.79 |
| 3,604,882 | 9/1971 | Seyfried | 219/10.69 |
| 3,610,861 | 10/1971 | Storey | 219/10.77 |
| 3,689,726 | 9/1972 | Howell | 219/10.71 |
| 4,075,450 | 2/1978 | Lavins, Jr. | 219/10.71 |
| 4,158,758 | 6/1979 | Kunioka et al. | 219/10.43 |
| 4,300,031 | 11/1981 | Reboux et al. | 219/10.41 |
| 4,317,978 | 3/1982 | Nebesar | 219/10.71 |

*Primary Examiner*—Roy N. Envall, Jr.
*Assistant Examiner*—M. M. Lateef
*Attorney, Agent, or Firm*—Body, Vickers & Daniels

[57] ABSTRACT

An induction heating arrangement for heating an end length of a forging bar following the cut-off therefrom of a previously heated and forged end length is arranged to heat the end length to a uniform temperature despite the existence of a residually heated terminal end from the previous heat. The heating arrangement has an induction heating coil with a longitudinally extending axial passageway therethrough for receiving the bar length to be heated by insertion into the passageway through the feed-in end thereof. A reciprocable flux diverter or robber ring is moved into the open other end of the coil passageway to surround the residually heated terminal end of the inserted bar end length, during a predetermined portion of the total coil heating cycle, to divert the flux from and prevent it from penetrating and heating the residually heated terminal end, whereby the inserted bar end length is evenly heated throughout its entire axial extent to the desired uniform forging temperature.

25 Claims, 7 Drawing Figures

INDUCTION HEATER ARRANGEMENT FOR FORGING BAR STOCK

BACKGROUND OF THE INVENTION

This invention relates in general to an induction heating arrangement for metal bar stock and more particularly to a heating arrangement for, and method of heating, an end length of forging bar stock to a uniform temperature throughout its axial extent directly following the cut-off therefrom of a previously heated and forged end length.

In the commercial production of forgings from metal bar stock, it is common practice to heat an end length portion of the extended bar stock to the desired forging temperature and then subject it to the required forging operations to form it into the desired forging which is then cut off the end of the bar. Thereupon, the end of the forging bar is again heated to forging temperature throughout a similar end length portion which is then formed into the desired forging and the latter cut off the bar end. This procedure is repeated until all of the usable length of the bar stock has been utilized. This forging practice is known in the art as "heating off the end of the bar". After a completed forging is cut off the bar end, a residual hot end spot or terminal end remains at the bar end.

Where the heating of the forging bar or workpiece is carried out in a combustion furnace, this residual hot spot at the forging bar end does not create any particular problem in heating the next bar end length portion to uniform forging temperature throughout its full extent since the furnace acts to bring the entire bar end length portion up to the same final temperature despite the existence of the hot end spot at the start of the heating operation. However, the residual hot spot at the bar end does create a problem where the heating of the bar end length portion is carried out in induction heating coil systems since these induce energy into and heat the workpiece as a function of the time the workpiece is being heated in the heating coil. Consequently, if the workpiece, at the time when induction heating thereof first begins, has two adjacent sections at substantially different temperatures, then after induction heating this temperature differential between the two workpiece sections will still exist. Accordingly, if a forging bar with a residual hot end spot is heated throughout an end length portion within an induction heating coil and the cool or as yet unheated section of the bar end length portion is brought up to forging temperature, the hot end spot will then be overheated and may even melt.

One proposal for overcoming this problem as disclosed in U.S. Pat. No. 4,075,450, Lavens, hereby made of record in the present application, has been to initially locate the residually heated end of the workpiece of forging bar entirely outside the full heating zone of the induction heating coil, while the cool or as yet unheated portion of the bar end length portion within the coil heating zone is brought up to substantially the same temperature as the residually heated bar end. Thereupon, the forging bar is retracted within the induction coil heating passageway, as by means of hydraulic cylinder operated pusher rod means, to locate the bar end entirely within the heating zone of the heating coil along with the rest of the bar end length portion to be forged, and the inductive heating of the forging bar then continued until the end length portion to be forged has attained the required forging temperature. This two-stage induction heating process, however, requires the locating of the bar end length portion in two different axial positions relative to the induction heating coil. Also, the correct axial positioning of the bar end length portion for the first stage of the heating operation, during which the residually heated terminal end is located entirely outside the induction heating coil, must be randomly selected depending on the particular temperature profile of the residually heated terminal end.

SUMMARY OF THE INVENTION

The present invention contemplates a new and improved induction coil heating arrangement for heating an end length portion of an elongated workpiece to a uniform processing temperature throughout the entire axial extent thereof, despite the existence of a residually heated terminal end from a previous forging operation, which heating arrangement overcomes all of the above referred to problems and others and is of comparatively simple and easily controlled character.

Briefly stated, in accordance with one aspect of the invention, an induction heating apparatus for heating an end length portion of an elongated workpiece is provided with a flux diverter ring or so-called "robber ring" mounted opposite the open rear end of the heating coil passageway for reciprocation movement axially into and out of the passageway. Should the workpiece have a residually heated terminal end, the flux diverter ring is moved axially into and maintained in an operative position within the coil passageway surrounding the heated terminal end of the workpiece therein, during a portion of the total heating cycle of the coil, to thereby divert the heating coil flux away from the heated terminal end of the workpiece and shield it from the flux so as to prevent overheating thereof during such heating cycle portion. The flux diverting ring in such case may be maintained in its operative flux-diverting position for the required time interval, during the heating cycle, to assure that the workpiece end length portion will be heated to a substantially uniform processing temperature throughout the entire axial extent thereof at the end of the heating cycle.

In accordance with another aspect of the invention, the induction heating apparatus is provided with control means for automatically moving the reciprocable flux diverter ring to its operative flux-diverting position within the heating coil passageway and controlling the time interval during which it is maintained in such operative position so as to assure that a workpiece end length portion positioned in the coil passageway, and having a residually heated terminal end, will be heated to a substantially uniform processing temperature throughout the entire axial extent thereof by the heating coil.

In accordance with a further aspect of the invention, the control means for effecting the reciprocation of the flux diverter ring between its inoperative and operative positions, respectively outside and inside the heating coil passageway, is preferably arranged to move the ring to and maintain it in its operative position surrounding the residually heated terminal end of a workpiece end length portion in the coil passageway after such terminal end reaches a selected processing temperature during the heating cycle of the apparatus.

In accordance with a still further aspect of the invention, a positioning stop means is mounted within the heating coil passageway adjacent the rear end thereof against which the terminal end of the workpiece abuts, during insertion of the workpiece and length portion into the heating coil passageway, to thereby locate such workpiece portion in proper axial heating position entirely therewithin. The positioning stop means may be either mounted in a fixed position within the heating coil passageway or it may be mounted for adjustment axially thereof, and it preferably is in the form of an elongated rod member extending axially through the flux diverter ring. Also, the positioning stop means may comprise an elongated push rod mounted for reciprocation axially through the heating coil passageway to push the workpiece in an endwise direction backwardly out of the coil passageway on completion of the heating cycle. The control means for effecting the reciprocation of the flux diverter ring between its operative and inoperative positions may also be arranged to control the reciprocation of the push rod to eject the workpiece at least partly from the coil passageway on completion of each heating cycle of the apparatus.

In accordance with another aspect of the invention, the flux diverter ring and also the positioning stop means are of hollow form for circulation of cooling liquid therethrough to prevent overheating thereof by the heating coil flux.

In accordance with still another aspect of the invention, the induction coil heating apparatus is arranged for two different selective modes of operation so that it can be made operative to heat to a substantially uniform processing temperature throughout its axial extent an end length portion of an elongated workpiece either having or not having a residually heated terminal end.

The principal object of the invention is to provide an induction coil heating apparatus of simple and accurately controllable character for heating an end length portion of an elongated workpiece, having a residually heated terminal end, to a substantially uniform processing temperature throughout the entire axial extent of the end length portion while located entirely within the heating coil of the apparatus during a heating cycle thereof.

Another object of the invention is to provide an induction coil heating apparatus as referred to above which will automatically operate to heat a workpiece end length portion, having a residually heated terminal end, to a substantially uniform processing temperature throughout the entire axial extent thereof while located entirely within the heating coil of the apparatus during the heating cycle thereof.

Still another object of the invention is to provide an induction coil heating apparatus as referred to above which will automatically operate to prevent overheating by the induction coil of a residually heated terminal end of a workpiece end length portion, positioned entirely within the heating coil passageway, during a predetermined time interval of the normal heating cycle of the apparatus.

A further object of the invention is to provide an induction coil heating apparatus as referred to above which will automatically operate to interrupt and discontinue further heating of a residually heated terminal end of a workpiece end length portion positioned entirely within the heating coil passageway, after the workpiece terminal end reaches a selected processing temperature during the heating cycle of the apparatus.

A still further object of the invention is to provide an induction coil heating apparatus as referred to above having a flux diverter ring automatically movable axially into and maintained in an operative flux diverting position in the coil passageway, around a heated terminal end of a workpiece end length portion positioned therein, to divert the heating flux of the coil away from and prevent it from overheating the terminal end during a predetermined time interval of a heating cycle of the apparatus.

Another object of the invention is to provide a novel method of heating to a substantially uniform processing temperature throughout its axial extent, an elongated workpiece end length portion having a residually heated terminal end.

Further objects and advantages of the invention will appear from the followed detailed description of a preferred species thereof and from the accompanying drawings.

DESCRIPTION OF THE PREFERRED EMBODIMENT

Figure 1:
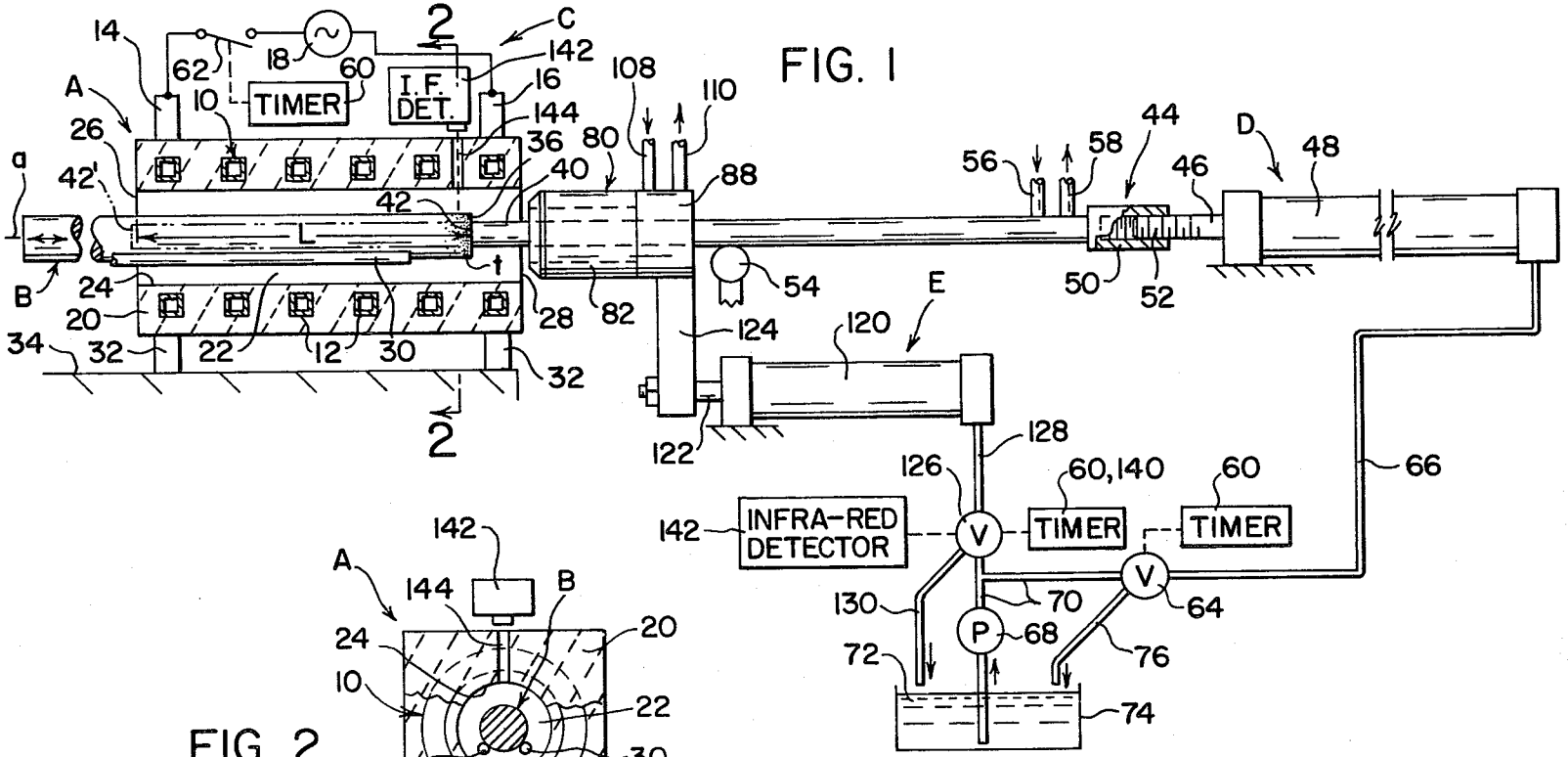
FIG. 1 is a schematic side elevational view of an induction coil heating apparatus comprising the invention with the induction heating coil thereof shown in section.
Figure 2:
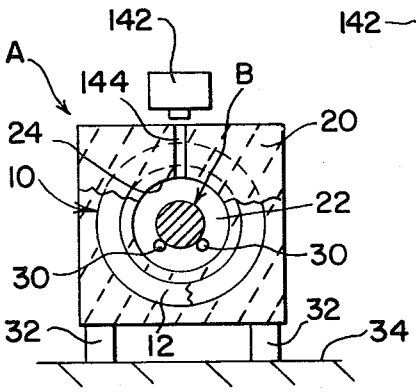
FIG. 2 is a transverse cross-sectional view on the line 2—2 of FIG. 1.

Referring now to the drawings wherein the showings are for the purpose of illustrating a preferred embodiment of the invention only and not for the purpose of limiting same, FIG. 1 illustrates an induction heating apparatus according to the invention and comprising an induction heating coil assembly A for inductively heating an end length portion L of an elongated workpiece B, such as a metal forging bar, to a uniform elevated processing or forging temperature throughout to permit the processing or forging thereof into an article (not shown) such as a forging or forged platter of articles which is then cut off the end of the workpiece. A succeeding end length portion L of the workpiece, which may include a residually heated end portion t of the previously heated end length portion from which a forging or forged platter of articles has been made and cut off, is then similarly heated to the processing or forging temperature in the induction heating coil assembly A and a second forging or forged platter of articles made therefrom and cut off the end of the workpiece. This heating and processing procedure is repeated until the entire usable length of the workpiece B has been used up.

Induction heating coil assembly A includes a multiturn induction heating coil 10 formed from a hollow electrical conductor helically coiled in a plurality of convolutions 12 about a linear coil axis a and connected at its opposite ends to a coolant inlet 14 and a coolant outlet 16 which are connected to a supply (not shown) of a suitable coolant. The inlet 14 and outlet 16 form spaced connector leads for connecting the full length of the coil 10 during each heating cycle of the apparatus, by means of electrical circuit means C, across an appropriate AC power supply schematically illustrated as a generator 18. The heating cycle is the time period during which the heating coil 10 necessarily must be continuously energized in order to heat the portion of the workpiece end length L in the coil passageway, other than any residually heated terminal end t thereof, to the desired processing or forging temperature. The residually heated terminal end t is also heated by the coil 10 during the heating cycle for the required portion or time interval thereof necessary to heat it to the desired processing temperature.

Although not necessary for the purposes of the invention, the heating coil 10 is shown embedded in a body of refractory material 20 formed with an elongated central workpiece receiving passageway 22 therethrough coaxial with the central coil axis a and defined by a peripheral wall portion 24 of the refractory body. The wall 24 of passageway 22 is of a contour generally matching the crosss-sectional contour of the workpieces B to be processed which, in the particular case illustrated, are metal forging bars or rods of circular cross-section. However, various other contours may be employed for the workpiece receiving passageway 22 in accordance with normal practice. Passageway 22 has an open front entrance or workpiece feed-in end 26 and is also open at its opposite or rear end 28. Each workpiece B is intermittently inserted endwise into the passageway 22 through the feed-in end 26 and then withdrawn therefrom through the same end 26 after the end length portion L of the workpiece lying within the passageway 22 has been heated to proper processing or forging temperature in accordance with the invention. After the heated end length portion L of the withdrawn workpiece B has been processed into a forging or other article such as a platter of forgings, and the article cut off or separated from the remainder of the workpiece, the end of the workpiece from which the forging or other article has been cut off and which is left with a short residually heated terminal end t is then reinserted into the heating coil passageway 22 through the feed-in end 26 thereof for the start of another heating cycle to heat another end length portion L of the workpiece to the desired processing or forging temperature which generally may be in the range of from 1700° F. to 2400° F.

For supporting the workpiece or forging bar B in proper axially centered position within the coil passageway 22 during the induction heating of the workpiece, suitable workpiece support means may be provided within the coil passageway such as a ceramic liner on the passageway wall or, as shown, a plurality of transversely spaced parallel support or slide rails 30 which extend longitudinally through the coil passageway 22 of the heating coil unit A parallel to the axis a thereof and on which the workpiece rests and slides. The slide rails 30 are suitably supported in place within the coil passageway 22 and they preferably extend outwardly beyond the feed-in end 26 of the heating coil unit A a short distance in order to properly support the workpiece B and facilitate the insertion thereof into the coil passageway 22. The heating coil unit A and its central workpiece receiving passageway 22 are formed of a length at least as great as, and preferably somewhat greater than the length of the end length portions L of the workpiece to be heated. The coil unit or assembly A is supported in place, with its coil axis a preferably extending approximately horizontally, on a plurality of support legs 32 fastened to and upstanding from a support base 34 such as a working bench top or platform stand.

In the operation of the induction heating coil system in accordance with the invention, the elongated workpiece or forging bar B is inserted endwise into the heating coil passageway 22 through its open feed-in end 26 and positioned in the passageway with its end length portion L located completely within and more or less coextensive with the full extent of the heating coil 10 and its effective heating zone but preferably with its terminal end face 36 recessed a short distance inwardly from the open rear end 28 of the passageway, as shown. For such purpose, a limiting end stop or positioning member such as an elongated metal pin or rod 40 extends a short distance axially into the open rear end 28 of the passageway 22 against the end face 42 of which the inserted end of the workpiece B abuts, on insertion into the open front end 26 of and passage through the passageway, to thereby locate the entire workpiece end length portion L in proper heating position therein. The end stop member 40 may be a fixed type stop adjustably mounted on the support base 34 for adjustment axially of the coil passageway 22 to locate its end face or stop surface 42 at the proper axial location in the passageway to position the workpiece end length portion L entirely within the axial extent of the heating coil passageway when abutted against the end face 42 of the stop member. Preferably, however, the end stop member 40 as shown is in the form of a movable push rod which extends axially of and rearwardly from the open rear end 28 of the passageway and is mounted for axial reciprocation within the heating coil passageway 22 to push the workpiece back out of or retract it at least to some extent from the coil passageway 22 on completion of each heating cycle of the apparatus.

The reciprocation of the movable end stop or push rod 40 to effect the retraction of the workpiece from its heating position within the passageway 22 may be produced by a reciprocable actuator 46 of an operating means D of any suitably actuated type, e.g., hydraulically. Pneumatically, electrically or other actuated type. As shown, the push rod 40 is connected at its back end by a suitable form of adjustable coupling 44 to the outer end of the reciprocable actuator 46 which, in the particular case illustrated, comprises the piston rod of a fluid-actuated cylinder 48 such as a hydraulic cylinder. The piston rod 46 is axially aligned with the coil axis a and push rod 40. The adjustable coupling 44 may, as shown, comprise an internally threaded female coupling member 50 fastened to the back end of the push rod 40 and screwed onto a screw-threaded outer end 52 of the piston rod 46 to permit axial adjustment of the push rod relative to the piston rod. The adjustable coupling 44 thus enables locating of the end stop face 42 of the push rod at the desired workpiece locating axial position within the coil passageway 22 when the piston rod 46 is in its retracted position. A supplementary support such as an idler roller 54 may be provided to afford added support for the interconnected push rod 40 and piston rod 46 at a point removed some distance from the cylinder 48. To prevent overheating of the stop or push rod member 40 by the heating coil flux, it may be of hollow form and provided with suitable internal passageways (not shown) for the circulation of a cooling liquid therethrough. For this purpose, the member 40 may be provided with inlet and outlet connections 56 and 58, respectively, for the cooling liquid, which connections communicate with the internal cooling liquid passageways of the stop or push rod member.

The hydraulic cylinder 48 is actuated to reciprocate and cause the push rod 40 to push the workpiece B back through the coil passageway 22 at the end of the heating cycle of the apparatus, when the workpiece end length portion L in the coil passageway reaches the desired processing or forging temperature. The end of the heating cycle may be determined either visually by an operator, or automatically as by means of an electrical signal from a time unit 60 or an optical pyrometer (not shown). If desired, this electrical signal may be fed or directed to the control circuit C for the coil 10 and operable to open the main switch 62 in this circuit and thus cause de-energization of the coil 10 either after a predetermined time interval, set in the timer unit 60, following the initial closure of the main switch 62 to initiate a heating cycle of the apparatus, or when the aforementioned pyrometer determines that the workpiece end length portion L has reached the desired processing temperature. The reciprocation of the piston rod 46 and the associated push rod 40 may be effected in any suitable way as, for example, by having the piston rod 46 extensible from the cylinder 48 by pressurized fluid introduced thereinto, and spring biased for retraction into the cylinder 48. Motion of the piston rod 46 is controlled by a two-way solenoid valve 64 communicating with the cylinder 48 through a conduit 66 and connectable either to a pump 68 through a conduit 70 for supplying the cylinder with pressurized hydraulic fluid from a supply 72 thereof in a sump 74, or to an outlet conduit 76 for emptying the fluid from the cylinder through conduit 66 and valve outlet conduit 76 back into the sump 74 on the spring biased retraction stroke of the piston rod 46 and push rod 40. The solenoid valve 64 may be actuated at the end of a heating cycle of the apparatus either by manual operation of a switch (not shown) in the electrical operating circuit for the valve, or by a signal from the timer unit 60.

Figure 3:
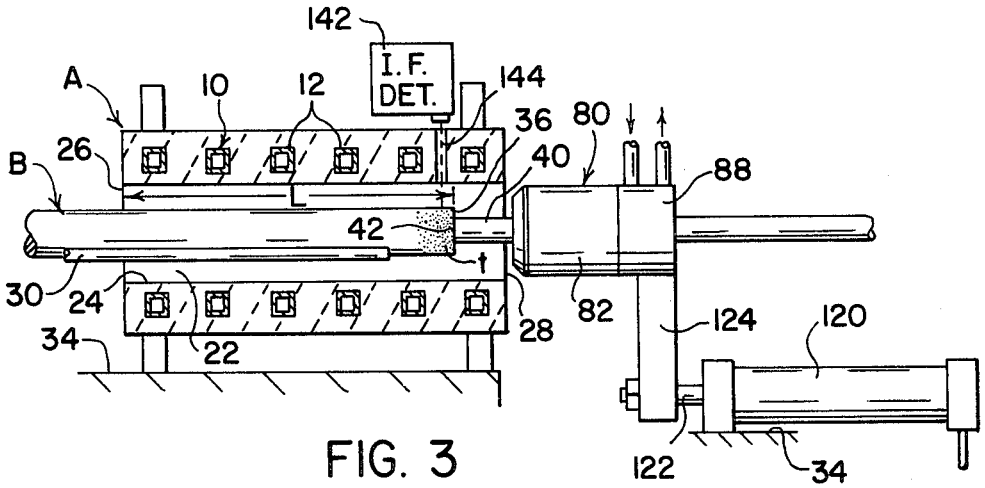
FIG. 3 is a partial elevational view, partly in section, of the induction coil heating apparatus of FIG. 1 with the flux diverter ring thereof shown in its retracted inoperative position.
Figure 4:
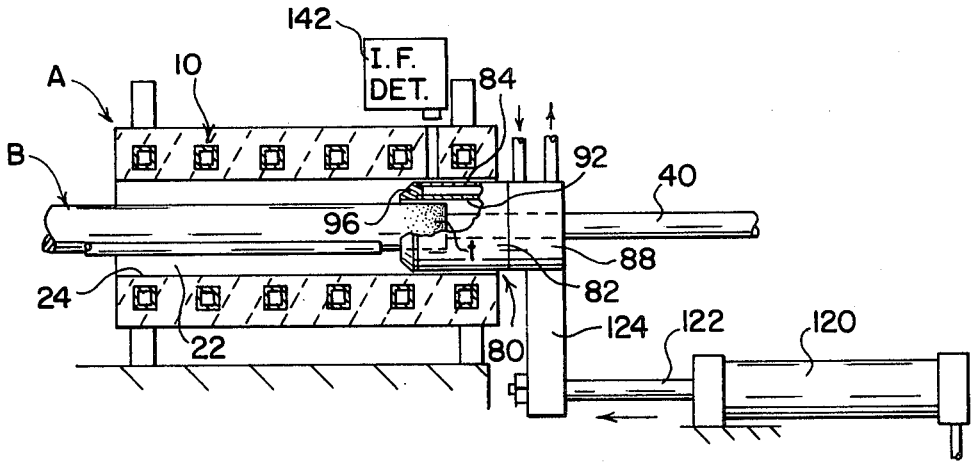
FIG. 4 is a view similar to FIG. 3 but showing the flux diverter ring in its advanced operative position and in partial section.

In accordance with the invention, a flux diverter ring or so-called robber ring 80 is movably mounted opposite and adjacent the open rear end 28 of the heating coil passageway 22 for movement axially thereof between an inoperative position outside the passageway as shown in FIGS. 1 and 3, and an operative position as shown in FIG. 4 inside the passageway and surrounding a residually heated terminal end t of a workpiece end length portion L located in proper heating position within the coil passageway 22. In its operative position surrounding the workpiece terminal end t, the flux diverter ring 80 operates to divert the heating flux of the energized induction coil 10 away from the residually heated terminal end t to prevent heating thereof by the coil 10. The flux diverter ring 80 is maintained in its operative flux-diverting position surrounding the workpiece terminal end t throughout only that portion or portions of the heating cycle required to prevent the residually heated terminal end t from being excessively heated during the full heating cycle to a temperature above the desired processing temperature. The flux-diverting action of the ring 80 thus assures that the workpiece end length portion L, despite initially having a residually heated terminal end t, nevertheless will be heated to a substantially uniform temperature throughout its entire axial extent during the heating cycle. To this end, the time during which the flux diverter ring 80 is maintained in its operative flux diverting position, during each heating cycle of the apparatus to heat a workpiece end length portion L having a residually heated terminal end t, is preferably automatically controlled in dependence on the particular temperature of the residually heated terminal end t, which temperature is apt to vary considerably from one workpiece end length portion L to the next.

Figure 5:
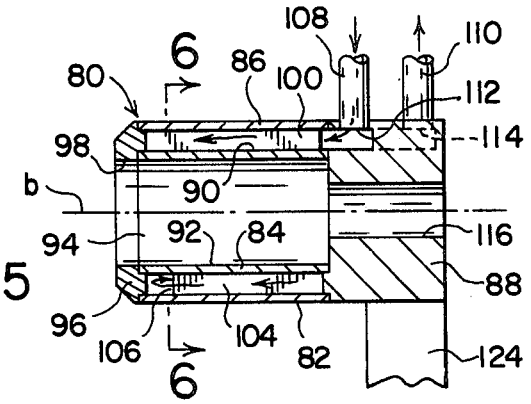
FIG. 5 is a longitudinal sectional view of the flux diverter ring of the apparatus.

Referring to FIG. 5, the flux diverter ring 80 essentially is in the general form of a double-walled tubular housing 82 comprised of inner and outer concentrically disposed tubular members 84 and 86, respectively, having a common longitudinal center axis b. Members 84, 86 are fixedly mounted at one end on a base support or head member 88 in radially spaced relation to provide an annular passageway 90 therebetween for circulation of a cooling liquid through the passageway to cool the flux diverting ring which is inductively heated by the coil 10 when the ring is in its operative flux-diverting position within the coil passageway 22. The tubular members 84, 86 are of a cross-sectional shape generally corresponding to the cross-sectional contour of the workpieces B to be processed. Thus, in the particular case illustrated wherein the workpieces B are metal forging bars or rods of circular cross-section, the tubular members 84, 86 are likewise of circular cross-sectional shape and are in the form of cylindrical sleeve members.

The sleeve members 84, 86 are made of a material such as copper, for instance, having a high electrical conductivity and low permeability. The inner wall 92 of the inner sleeve member 84 defines an axial passageway 94 of circular cross-sectional contour having a diameter slightly larger than that of the circular cross-section workpiece bars or rods B so as to closely accommodate and permit entry of the workpieces into the passageway 94 with a slight clearance space therebetween, as shown in FIG. 4. The outer sleeve member 86 has an outside diameter slightly less than the diameter of the heating coil passageway 22 so as to permit axial movement of the tubular housing 82 axially thereinto with a slight clearance space therebetween, as also shown in FIG. 4.

Figure 6:
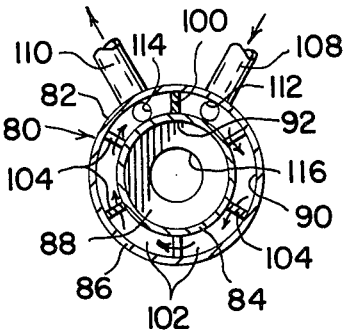
FIG. 6 is a transverse cross-sectional view of the flux diverter ring taken on the line 6—6 of FIG. 5; and, FIG. 7 is a linear laid out schematic view of the cooling liquid passageway arrangement of the flux diverter ring.
Figure 7:
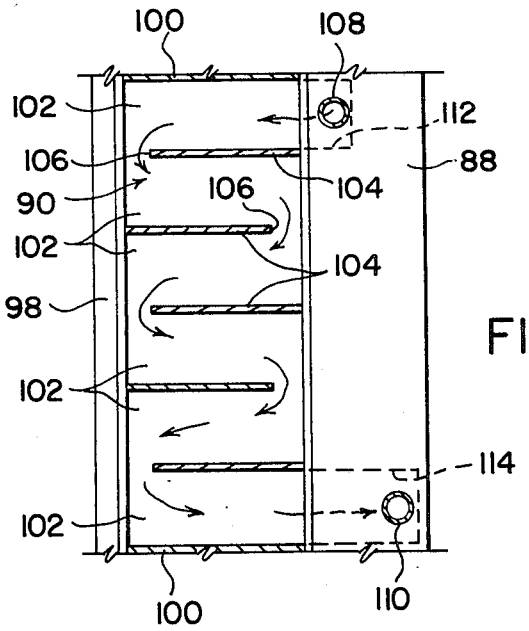

The mounting head member 88 on which the sleeve members 84, 86 are supported at one end, closes off the corresponding end of the cooling liquid passageway 90 between the sleeve members. At its other end, the passageway 90 is closed off by a metal ring or annular end closure member 96 secured to the corresponding ends of the sleeve members 84, 86 and also made of a material such as copper, for instance, having a high electrical conductivity and low permeability. The end closure member 96 has a central axial opening 98 extending therethrough in axial alignment with the axis b of the housing member 82 and of a diameter corresponding to that of the passageway 94 through the inner sleeve 84. The passageway 90 is blocked off around its annular extent, at one point therearound, by a longitudinal partition 100 extending the full axial extent of the passageway between the head member 88 and end closure member 96. Also, as diagrammatically illustrated in the laid out showing in FIG. 7, the annular passageway 90 is divided into a series of individual flow chambers 102 disposed therearound by a plurality of longitudinal divider walls 104 of shorter length than the axial extent of the passageway and alternately extending axially of the sleeves 84, 86 from the head member 88 and the end closure member 96 in more or less uniformly spaced apart relation around the annular passageway to provide end connection openings 106 between successive ones of the flow chambers 102. The divider walls 104 and end openings 106 thus provide a back and forth sinous flow path for the passage of cooling liquid through the passageway 90, as indicated by the arrows in FIGS. 5 to 7. Cooling liquid under pressure from a suitable source is supplied to and discharged from the passageway 90 through flexible conduits (not shown) respectively connected to inlet and outlet nipple connections 108 and 110 on the head member 88, which communicate with respective ones of the two flow chambers 102 immediately adjacent opposite sides of the partition wall 100 through respective axial extending bore openings 112 and 114 in the head member 88.

As shown in FIG. 1 and as described hereinabove, the flux diverter ring 80 is mounted opposite the rear end 28 of and in axial alignment with the coil passageway 22 for reciprocable movement axially of the passageway into and out of the rear end 28 thereof between its previously mentioned inoperative and operative positions. In this connection, the head member 88 is provided with an axial passageway 116 therethrough of large enough size to accommodate and permit the end stop push rod 40 to extend through the head member 88 and inner sleeve 84 of the tubular housing 82 and into the rear end 28 of the coil passageway 22 to its workpiece locating position therein, as shown in FIG. 1. The reciprocative movement of the flux diverter ring 80 is effected by actuating means E of any suitably operated type, i.e., hydraulically, pneumatically, electrically, or other operated type. In the particular case illustrated, the actuating means E comprises a hydraulic type fluid-actuated cylinder 120 mounted in a position laterally offset from the axis a of the coil passageway 22, i.e., below the coil axis a in the form of the invention shown in FIG. 1, and with the piston rod 122 of the cylinder 120 extending parallel to the coil axis a. The outer end of piston rod 122 is fastened to a laterally extending bracket arm 124 extending from the head member 88 of the flux diverter ring 80.

The reciprocation of the piston rod 122 to axially move the flux diverter ring 80 between its inoperative and operative positions may be effected in any suitable manner as, for example, by having the piston rod 122 extensible from the cylinder 120 by pressurized fluid introduced thereinto, and spring biased for retraction back into the cylinder. In the particular case illustrated, the extension stroke of the piston rod 122 moves the flux diverter ring 80 from its retracted inoperative position outside the coil passageway 22 to its advanced flux diverting position inside the coil passageway and surrounding the residually heated terminal end t of the workpiece end length portion L positioned in the coil passageway. The operation of the cylinder 120 is controlled by a two-way solenoid valve 126 communicating with the cylinder 120 through a conduit 128 and connectable either to the pump 68 through conduit 70 for supplying the cylinder with pressurized hydraulic fluid from the supply 72 thereof to extend the piston rod 122, or to a valve outlet conduit 130 for emptying the fluid from the cylinder through conduit 128 and 130 back into the sump 74 on the spring biased retraction stroke of the piston rod 122.

As described hereinabove, during each heating cycle of the coil 10 to heat a workpiece end length portion L having a residually heated terminal end t to a uniform processing temperature throughout its axial extent, the flux diverter ring 80 is moved axially to and maintained in its operative position surrounding the heated terminal end t for the necessary time or portion of the heating cycle required to prevent overheating of the terminal end portion t above the desired processing temperature and thus assure that such terminal end portion will have substantially the same temperature throughout its axial extent as the rest of the workpiece end length portion L at the end of the heating cycle. In the preferred arrangement of the apparatus according to the invention, the entire workpiece end length portion L, including any residually heated terminal end t thereof, is heated in the coil passageway 22 by the energized coil 10, and the flux diverter ring 80 then indexed to its operative flux diverting position in the coil passageway as soon as the residually heated terminal end t reaches a predetermined temperature, which may be the desired processing or forging temperature. The indexed flux diverter ring 80 is then maintained in its operative position to prevent any further heating of the terminal end t during the remaining portion of the full heating cycle required to heat the originally unheated portion of the workpiece end length portion L to such processing or forging temperature.

The determination as to when the residually heated terminal end t has been heated to the desired processing or forging temperature during the course of the heating cycle of the apparatus, and when the flux diverter ring 80 should be indexed to its operative flux diverting position to prevent further heating of the workpiece terminal end t, may be accomplished manually or preferably automatically in response to an electrical signal from either the timer unit 60 or another time unit 140, or from an infrared detector or optical pyrometer 142 supported opposite a window or sight opening 144 located in the refractory body 20 between windings of the coil 10 to sense through the opening 144 the temperature of the workpiece terminal end t. The time interval required to bring the residually heated terminal end t of the workpiece B up to the desired processing or forging temperature may be predetermined on the basis of the material properties of each particular type of workpiece B being processed or on the basis of tests, and set in the timer unit 60 or 140. At the end of that time interval, the timer unit 60 or 140 or the detector 142 will then send a signal to the control circuit (not shown) for the valve 126 to cause the actuation of the hydraulic cylinder 120 so as to index the flux diverter ring 80 to its operative flux diverting position, thus preventing any further heating of the terminal end t during the remainder of the full heating cycle.

When the workpiece end length portion L has been heated in the coil 10 throughout its entire axial extent to the desired processing temperature, the workpiece is removed from the coil and the heated end length L thereof then processed in the desired manner in a forging press. At such time, the heating coil 10 may either be kept continuously energized for the start of another heating cycle of the apparatus to heat, for example, a different workpiece, or the coil instead may be de-energized as previously described by the opening of the main switch 62 in the control circuit C. The opening of the switch 62 may be effected either manually by an operator, or automatically in response to another signal from the timer 60. At the same time, this same signal from the timer 60 may be employed to operate the valve 64 to cause the actuation of hydraulic cylinder 48 so as to reciprocate the push rod 40 through the coil passageway 22 to eject the heated workpiece B either partially or completely therefrom. If desired, however, the operation of the valve 64 to cause the actuation of the push rod reciprocating cylinder 48 may be manually controlled by an operator. Also at the end of the heating cycle, the flux diverter ring 80 is retracted to its inoperative position outside the coil passageway 22 by the actuation of the control valve 126 for the cylinder 120 to cause the retraction of its piston rod 122 and the associated flux diverter ring 80. The actuation of the control valve 126 to cause the retraction of the flux diverter ring 80 may be effected by the appropriate alteration of the control circuit for the valve 126 either manually by an operator or automatically as by still another signal from the timer 60.

It will be evident that the induction coil heating arrangement according to the invention affords ready variable control of the extent of heating of the residually heated terminal t of a workpiece end length portion L during each heating cycle of the apparatus, depending on the particular temperature of the terminal end t which, as will be appreciated, generally varies from one end length portion L to the next during the course of a so-called "heating off the end of the bar" type forging process. Through this feature of the invention, the flux diverter ring 80 can be indexed to and maintained in its flux-diverting operative position for a longer period or time interval of each heating cycle, for workpieces having terminal ends t at higher temperature as the start of the heating cycle, than the time interval required for workpieces with terminal ends at lower initial temperatures, to accomplish in each case the heating of the workpiece end length portion L to the same uniform processing temperature throughout their axial extents.

It should be understood that the induction heating apparatus as described hereinabove is utilized principally for heating the end length portion L of a workpiece B from which a previously heated and mechanically processed end portion has been cut off, leaving a residually heated terminal end t. However, the induction coil heating arrangement according to invention can be also employed to initially heat the end length portion L of a new and as yet unheated workpiece B, i.e., one not having a residually heated end t, to the desired processing temperature. In such case, if a timer unit 60 or 140 is employed to index the flux diverter ring 80 to its operative position, the timer unit simply would be suitably rendered inoperative as by another signal effective to disconnect the timer unit from the control circuit for the operating valve 126 that actuates the hydraulic cylinder 120. The flux diverter ring 80 then would remain stationary in its inoperative position outside the heating coil passageway 22 during the entire period of the heating cycle required to heat the initially unheated workpiece end length portion L to the desired processing temperature. If an infra-red detector unit 142, however, is employed in the aforementioned case where an entirely cook workpiece end length L is to be heated in the coil, i.e., one not having a residually heated terminal end t, then in that instance the infra-red detector 142 sensing the temperature of the initially cool terminal end t simply would not detect a temperature therefor reaching the desired processing temperature until the very end of the heating cycle and thus would not operate to index the flux diverter ring 80 to its operative flux-diverting position at any time during the heating cycle.

It will be appreciated also that in some instances a sequence of indexes of the flux diverter ring 80 to and maintainence thereof in its operative flux-diverting position during a heating cycle may be necessary in order to obtain the desired heat uniformity throughout the axial extent of the workpiece end length portion L being heated in the coil passageway 22. Such a sequence of indexes of the ring 80 to its operative position may be obtained by the provision of a separate control circuit arranged to override or be substituted for the timer or infra-red detector-actuated control circuit as described hereinabove and manually operable, for instance, to index the flux diverter ring 80 to its operative position at the desired time, and maintaining it in such position for the required time interval or intervals during the heating cycle of the apparatus.

With such an alternative arrangement, the flux diverter ring 80 may be initially positioned in its operative flux-diverting position at the start of a heating cycle of the apparatus and maintained in its operative position during such initial time interval of the total heating cycle as is required for heating the initially unheated portion of the workpiece end length L, other than its residually heated terminal end t, to a temperature approximately corresponding to that of the initially heated terminal end t. At such time, the flux diverter ring 80 is then retracted to and maintained in its inoperative position outside the coil passageway 22 during the remainder of, or during one or more portions of the remainder of the heating cycle, such as will assure that the entire axial extent of the workpiece end length portion L including its terminal end t will be heated to the desired uniform processing temperature.

The invention has been described with reference to preferred embodiments. Obviously, modifications and alterations will occur to others upon the reading and understanding of this specification. It is my intention to include all such modifications and alterations insofar as they come within the scope of the appended claims or the equivalents thereof.

Having thus described the invention, the following is claimed:

1. An induction heating apparatus for heating an end length portion of an elongated workpiece to a processing temperature during a heating cycle of said apparatus, said end length portion having a terminal end residually heated from a prior heating cycle and an axial length substantially less than said end length portion, said apparatus comprising: an inductor having a multiturn heating coil with a linear coil axis and a workpiece-receiving passageway coaxial with said coil for accommodating the said end length portion entirely therewithin; said passageway having an open front end at one end of said coil through which the workpiece is inserted residually heated end first, into said passageway and an open rear end at the other end of said coil, a movable flux diverter ring of high electrical conductivity, low permeability material and normally located in an inoperative position outside and adjacent the said rear end of said coil passageway, and means mounting said flux diverter ring for movement from said inoperative position into the said rear end of and axially aligned with said passageway and moving said ring to an operative position therein surrounding the said residually heated terminal end of the workpiece, during one or more portions of said heating cycle, to divert the flux generated by the energized coil away from said heated terminal end and prevent heating thereof during said heating cycle portion or portions.

2. An induction heating apparatus as defined in claim 1 wherein the said flux diverter ring is moved into and maintained in its said flux-diverting operative position during one or more portions of said heating cycle sufficient to assure the heating of the said workpiece end length portion to a substantially uniform processing temperature throughout the entire axial extent thereof during said heating cycle.

3. An induction heating apparatus as defined in claim 1 and including means for moving the said flux diverter ring from said inoperative position into its said flux-diverting operative position after the said residually heated terminal end of the workpiece reaches the said processing temperature during a first portion of said heating cycle.

4. An induction heating apparatus as defined in claim 3 wherein the said flux diverter ring is maintained in its said flux-diverting operative position throughout the remaining portion of said heating cycle following the said first portion thereof.

5. An inductive heating apparatus as defined in claim 1 and including actuating means for reciprocating said flux diverter ring axially of said coil between an inoperative position axially aligned with and outside said passageway and the said flux-diverting operative position inside said passageway.

6. An induction heating apparatus as defined in claim 1 wherein the said flux diverter ring is made of copper.

7. An inductive heating apparatus as defined in claim 1 wherein the said flux diverter ring is of hollow form providing an internal passageway for the circulation of cooling liquid therethrough.

8. An inductive heating apparatus as defined in claim 1 and including a stop member extending into the said open rear end of and blocking said passageway adjacent said rear end to abut the forward end of a workpiece inserted into said passageway through the said open front end thereof and locate the said end length portion of the inserted workpiece in a predetermined axial position within said passageway.

9. An inductive heating apparatus as defined in claim 5 wherein the said actuating means comprises a first fluid-actuated cylinder having a piston rod connected to said flux diverter ring.

10. An inductive heating apparatus as defined in claim 5 and including control means for energizing said coil and operating said actuating means, said control means comprising: electrical circuit means for connecting the said coil to an AC power source to energize said coil and initiate a said heating cycle; and time delay means operative associated with said circuit means to operate the said actuating means at a preselected time interval, following the start of a said heating cycle, to move said flux diverter ring to said flux-diverting operative position inside said passageway.

11. An inductive heating apparatus as defined in claim 5 and including control means comprising first electrical circuit means adapted to selectively connect said coil to an AC power supply to energize said coil and initiate a said heating cycle and second electrical circuit means adapted to operate said actuating means so as move said flux diverter ring to its said flux-diverting operative position inside said passageway, said control means further including a time delay means operatively associated with said second circuit means to effect the operation of said actuating means by said second circuit means, at a preselected time interval following the start of a said heating cycle by said first conduit means, to move said flux diverter ring to said flux-diverting operative position.

12. An inductive heating apparatus as defined in claim 10 wherein the said time delay means comprises a timer unit.

13. An inductive heating apparatus as defined in claim 10 wherein the said time delay means comprises an optical pyrometer for sensing the temperature of the said residually heated terminal end of the workpiece during a said heating cycle and effecting the said operation of said actuating means when the said residually heated terminal end reaches a selected temperature at least equal to the said processing temperature.

14. An induction heating apparatus as defined in claim 8 wherein the said stop member comprises an elongated rod extending axially of said coil and through said flux diverter ring into the said rear end of said passageway.

15. An induction heating apparatus as defined in claim 14 wherein the said stop member is fixed and located with its inserted end at a predetermined position in said passageway adjacent the said rear end thereof.

16. An induction heating apparatus as defined in claim 14 wherein the said stop member comprises a push rod mounted for reciprocation within both said passageway and said flux diverter ring to push the said workpiece backwardly in said passageway when the said workpiece end length portion heated therein reaches the said processing temperature, and operating means associated with and operative to reciprocate said push rod.

17. An induction heating apparatus as defined in claim 16 wherein the said operating means comprises a second fluid-actuated cylinder.

18. An induction heating apparatus as defined in claim 10 and including a stop member comprising a push rod extending into the said open rear end of and blocking said passageway adjacent said rear end to abut the forward end of a workpiece inserted into said passageway through the said open front end thereof and locate the said end length portion of the inserted workpiece in a predetermined axial position within said passageway, said push rod being mounted for reciprocation axially within both said passageway and said flux diverter ring to push the said workpiece backwardly in said passageway, and operating means for reciprocating said push rod in said passageway, said time delay means also being operatively associated with and actuating said operating means at the end of a said heating cycle.

19. An induction heating apparatus as defined in claim 18 wherein said time delay means comprises a timer unit.

20. An induction heating apparatus as defined in claim 18 wherein the same time delay means comprises an optical pyrometer for sensing the temperature of the said terminal end of the workpiece during a said heating cycle and effecting the operation of said actuating means when the said residually heated terminal end reaches a selected temperature at least equal to the said processing temperature.

21. An induction heating apparatus as defined in claim 18 wherein the same time delay means comprises: a first timer unit for operating the said actuating means at a preselected time interval, following the start of a said heating cycle, to move said flux diverter ring to said flux-diverting operative position inside said passageway; and a second timer unit for actuating said operating means at the end of a said heating cycle to move said push rod so as to push the workpiece backwardly in said passageway.

22. The method of heating, in an axial passageway of an elongated multiturn inductor including a linear heating coil coaxial with said passageway, an end length portion of an elongated workpiece having a residually heated terminal end, comprising the steps of: stationarily positioning the said end length portion of the workpiece in the said passageway and entirely within the effective heating zone of the coil, electrically energizing the said coil to inductively heat the said workpiece end length portion in said passageway during a predetermined heating cycle of said coil, and surrounding the said residually heated terminal end only of said workpiece end length portion with a flux diverter ring during a portion of said heating cycle to divert the heating flux of said coil away from said terminal end and prevent heating thereof by said coil during said heating cycle portion.

23. The method as defined in claim 22 wherein said workpiece end length portion is heated throughout its entire axial extent by said coil during a first portion of the said heating cycle thereof until the said residually heated terminal end of the workpiece reaches a predetermined elevated processing temperature, and then surrounding the said terminal end with the said flux diverter ring during the remaining portion of said heating cycle to prevent any further heating of said terminal end by said coil during said remaining heating cycle portion.

24. An induction heating apparatus as defined in claim 1 wherein the said flux diverter ring comprises a pair of concentric sleeve members disposed one within and spaced from the other to define an annular chamber therebetween closed at the opposite ends of said sleeves for circulation of a cooling medium through said chamber.

25. An induction heating apparatus as defined in claim 14 wherein the said elongated rod comprising said stop member is provided with internal passageways extending longitudinally therethrough for the circulation of a cooling medium through said rod.

* * * * *